United States Patent [19]

Pond

[11] 4,153,251

[45] May 8, 1979

[54] LACROSSE STICK MESH

[76] Inventor: Robert B. Pond, Rte. #1, Taneytown, Md. 21787

[21] Appl. No.: 742,199

[22] Filed: Nov. 16, 1976

[51] Int. Cl.[2] ..... A63B 59/02; A63B 51/00

[52] U.S. Cl. ..... 273/96 D

[58] Field of Search ..... 273/73 D, 105 R, 96 R, 273/96 B, 96 D; 43/7

[56] References Cited

U.S. PATENT DOCUMENTS

| | | | |
|---|---|---|---|
| 971,773 | 10/1910 | Muezler | 273/73 D |
| 3,822,062 | 7/1974 | Tucker et al. | 273/96 D |
| 3,905,088 | 9/1975 | Tucker et al. | 273/96 D |
| 4,022,477 | 5/1977 | Pool | 273/96 D |

FOREIGN PATENT DOCUMENTS

| | | | |
|---|---|---|---|
| 452096 | 10/1948 | Canada | 273/96 D |
| 22770 of | 1907 | United Kingdom | 273/105 R |

OTHER PUBLICATIONS

The Sporting Goods Dealer, p. 122, Mar. 1974, Snocraft advertisement.

*Primary Examiner*—Richard T. Stouffer
*Assistant Examiner*—Lawrence E. Anderson
*Attorney, Agent, or Firm*—Larson, Taylor and Hinds

[57] ABSTRACT

An improved net for covering the head of a lacrosse net. The net is formed of a flexible web made of a non-plastically deformable material having preformed interstices whose size varies in a predetermined manner. A catching or pocket region is formed in the web by having large size interstices in a region centered on the longitudinal axis of the web. The size of the interstices becomes smaller as the distance from the center region increases. When the web is attached to the head of a lacrosse stick, the center region is automatically deformed by a lacrosse ball to form a pocket. The need for a user of the stick to form or shape the pocket before using the stick is eliminated. Also, the position of the pocket with respect to the head is adjustable by moving the web longitudinally before affixing the web to the head. The depth of the pocket is adjustable by varying the amount of web material connected between side walls of the head. A throwing region in the web is formed by an area of the web having relatively small size interstices.

The web is affixed to the head in such manner that the transverse tension on the web in the throwing region is greater than the transverse tension in the catching region.

4 Claims, 4 Drawing Figures

LACROSSE STICK MESH

BACKGROUND OF THE INVENTION

A lacrosse stick is generally comprised of a handle or stick portion which is part of or connected to the throat of a closed, generally V-shaped head portion. A net is affixed to the head portion to define a throwing and catching area. The net contains a shaped depression or pocket to improve control and handling of a lacrosse ball. The net can be comprised of at least one plastic material that is irreversibly distorted by repeated loading to form the pocket. This method of pocket forming requires time and effort to form the pocket and the properness of the pocket in the net depends upon the skill and experience of the person forming the pocket. Another method of forming a pocket is disclosed in U.S. Pat. No. 3,822,062, entltled "Mesh Webbing for a Lacrosse Stick". The net is formed of expandible knitted mesh which is affixed to the head in such manner that the end portion of the mesh closest to the throat portion of the head is substantially free of expansion and the other end portion is widely expanded in accordance with the maximum width of the head. The unexpanded portion of the mesh is readily deformable to form a pocket in the vicinity of the throat portion of the head. A problem with this method of forming a pocket is that it is not possible to move the location of the pocket in accordance with the desires of a user of the lacrosse stick.

A cantiliver motion of the stick is used to propel the ball from the pocket of the net. The arcuate motion of the stick causes the ball to roll upward from the pocket toward the head of the stick. The natural and undesired action of the cantilevered motion of the stick is to generate a velocity component on the ball normal to the intended direction. The tendency of the ball to fly off the end of the stick in throwing is corrected by weaving one or more separate strings into and across the top of the net at the desired point of release of the ball. The discontinuity of the throwing string is sufficient to check the outward velocity of the ball, and the release point of the ball from the stick is thereby defined. The tension of the throw string is important, and if the throw string is too loose, the stick will throw high, and if the throw string is too tight the ball will hook or be deflected downward. The throw string tends to loosen with play and needs adjustment periodically.

SUMMARY OF THE INVENTION

The aforementioned problems encountered with the prior art nets, pockets, and throw stings have been overcome by my present invention. I have discovered that, by using a knitted mesh that has an areal density which varies both longitudinally (along the extended axis of the handle) and transversely, it is possible to make an improved net with a preformed shape that defines both the pocket and throwing areas. The variation in areal density is accomplished by using relatively large size interstices in the center of the pocket area and relatively small size interstices in the boundaries of the pocket area and in the throwing area. The transition from large to small size interstice occurs either relatively continuously or in a series of discrete bands of progressively smaller size. Also, the progression longitudinally differs from the transverse progression. The location of the pocket with respect to the throat area is varied by moving the net longitudinally with respect to the head before affixing it. The depth of the pocket is determined by varying the amount of net material between the walls of the stick. The release area of a ball from the stick is determined by both the shape and longitudinal variation in areal density of the net and the variation in net tension. The variation in net tension is accomplished by affixing the net to the head in such manner that there is relatively little transverse tension on the net in the pocket area and significantly more transverse tension in the release area. In a preferred embodiment this is accomplished by using one lace to affix the top of the net and throwing area to the stick and a second lace to affix the remainder of the net to the stick.

BRIEF DESCRIPTION OF THE DRAWINGS

In the subsequent detailed description, reference is made to the accompanying drawings, wherein the same reference characters indicate corresponding parts throughout the several views of the drawing and in which.

DESCRIPTION OF THE PREFERRED EMBODIMENT

Since lacrosse sticks and heads for lacrosse sticks are well known, see for instance U.S. Pat. No. 3,507,495, entitled "Lacrosse Stick," the present description will be directed in particular to elements forming part of, or cooperating more directly with improved nets in accordance with the present invention. It is to be understood that elements not specifically shown or described may take various forms well known to those skilled in the art.

Figure 1:
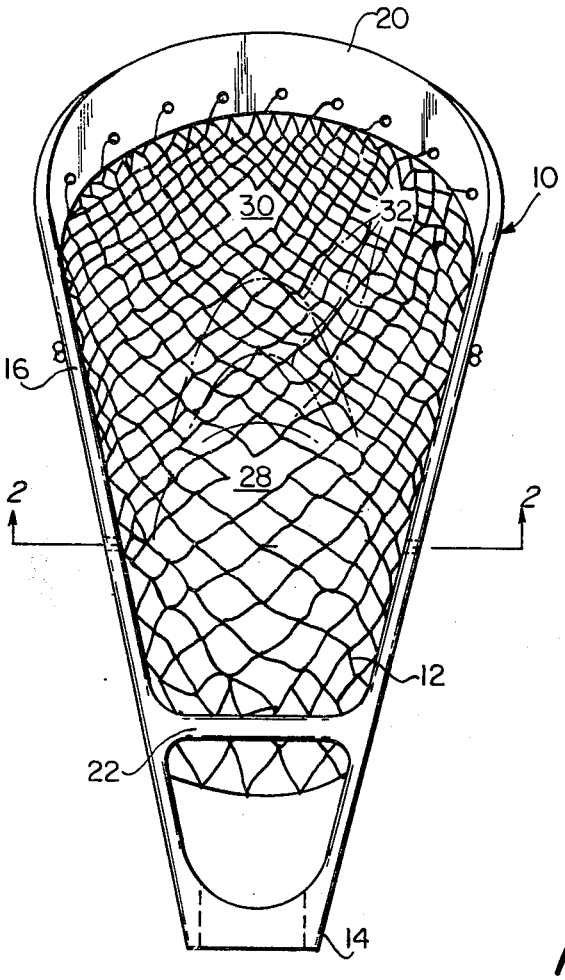
FIG. 1 is a front elevational view of the head of a lacrosse stick incorporating one embodiment of the improved net of the present invention.
Figure 2:
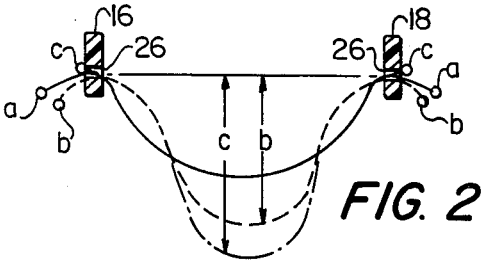
FIG. 2 is a cross sectional view taken along line 2—2 of FIG. 1 showing transverse edge contours, designated (a), (b) and (c) respectively, of different pockets formally in the head of FIG. 1.

Referring now to FIG. 1, a head portion, generally designated 10, of a lacrosse stick and one embodiment of the improved web or net of the present invention designated 12, are illustrated. Head 10 defines a closed, generally V-shaped area and includes a bottom or throat region 14 adopted to receive a lacrosse handle or stick (not shown), divergent side walls 16, 18 extending from throat 14 to a generally transverse top or end wall 20, and a stop 22. Wall 20 contains a plurality of holes or openings 24 for affixing the top of net 12 to head 10. In like manner, walls 16, 18 and stop 22 contain holes, or openings two of which designated 26, are illustrated in FIG. 2 for affixing the sides and bottom of net 12 to head 10. It is understood that a combination of tabs, tab holes or openings can be used in addition to or in place of openings 24, 26.

Figure 4:
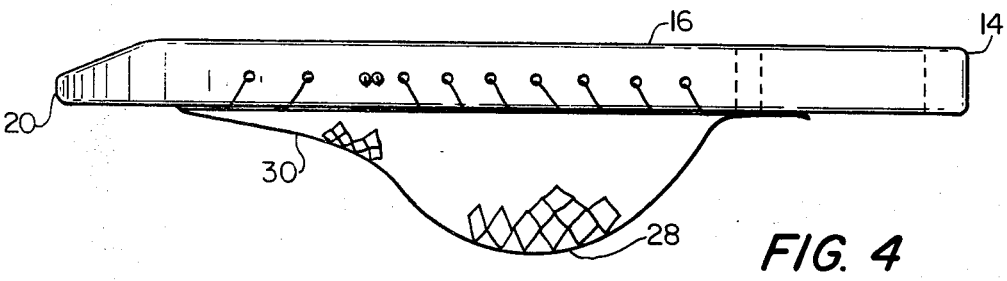
FIG. 4 is a fragmentary side elevational view of the lacrosse stick head of FIG. 1 showing the longitudinal edge contour of the preformed pocket in the net of FIG. 1.

Net 12 is a flexible net in which there is not needed a plastically deformable material to define the pocket, and which is composed of a fixed, woven net which is preformed into a shape defining a desired and useable pocket and throwing area as shown in FIG. 4. The material comprising net 12 is substantially not deformable and the weave is made from linen, nylon or other synthetic fiber, cotton or a thread or fiber which is composed of a combination of materials. The structure of net 12 is such that it is fixed, and there are preferably no sliding parts to the weave.

The contour of net 12 comprising the pocket area generally designated 28, and the release area, generally designated 30, is predetermined without subsequent distortion of net 12 or without the use of throw strings. The transverse depth of pocket 28 is basically determined by making net 12 larger in size than head 10. Net 12 is tied onto the walls 16, 18 with differing net widths to generate different pocket depths. The even contour shown in FIG. 2(a) is not optinium for precisely locating the ball laterally in the center of head 12; in fact, the contour shown in FIG. 2(a) is not typical for a good pocket. In my invention an improved pocket is formed by altering the areal density of net 12 by decreasing the size of the interstices as their distance increases from the center portion of pocket 28. Preferably the ratio of the size of the largest to the smallest interstices (in terms of their major diameters) varies from 3:2 to 30:1. The variation in weave density effects a local change in net stiffness. For example, the bottom or center of pocket 28 is composed of a weave of relatively large interstices (0.3–1.3 inches major diameter) and the boundaries of pocket 28 near the walls 16, 18 are composed of interstices one third to one half the size of the largest interstices in pocket 28. The transition from large interstices at the center of pocket 28 to smaller interstices at the edges of pocket 28 near walls 16, 18 is made relatively continuously or in one or more bands, each of which is composed of relatively uniform interstices size. The effect of this type of net composition is to produce a narrow and stable pocket. The depth of pocket 28 can be set as shown by FIGS. 2(b) and 2(c) by varying the net attachment points at walls, 16, 18 and thereby the amount of net material between the walls 16, 18. The contour of pocket 28 is predetermined by the variation in the net density.

The contour of pocket 28 on the stick axis is also varied by controlling the weave density in a manner like that for determining the pocket contour. The deepest part of pocket 28 is placed by the user at any location along the stick axis, and the extent of pocket 28 along the stick axis is controlled by varying the net density in a manner as previously described for the transverse pocket section. The longitudinal contour of pocket 28 is determined by varying the net density such that the locus of the ball release is determined without the use of throw strings. The optimum longitudinal shape for ball release contains an inflection or a slope change in the top half of net 12, as illustrated in FIG. 4. The necessary shape for adequate ball release is easily generated by producing a net of continuously decreasing interstice size proceeding from the center point of pocket 28 to top 20 of head 10. In a preferred embodiment, a ball (not shown) is constrained laterally at the centerline of net 12 for the purpose of throwing accuracy by producing a slight depression on the centerline of net 12 in ball release region 30. This effect is produced by arranging the weave of net 12 so that it extends from the generally circular or elliptical shaped center of pocket 28 towards wall 20, so that approximately equal size interstices be on elliptical or "V" shaped contours, generally designated 32, the apexes of which are directed toward the center of the top of head 10. In throwing the ball is constrained near the centerline of net 12 and is caused to release reproduceably from the head 10 near the region of slope change in the top half of net 12.

Figure 3:
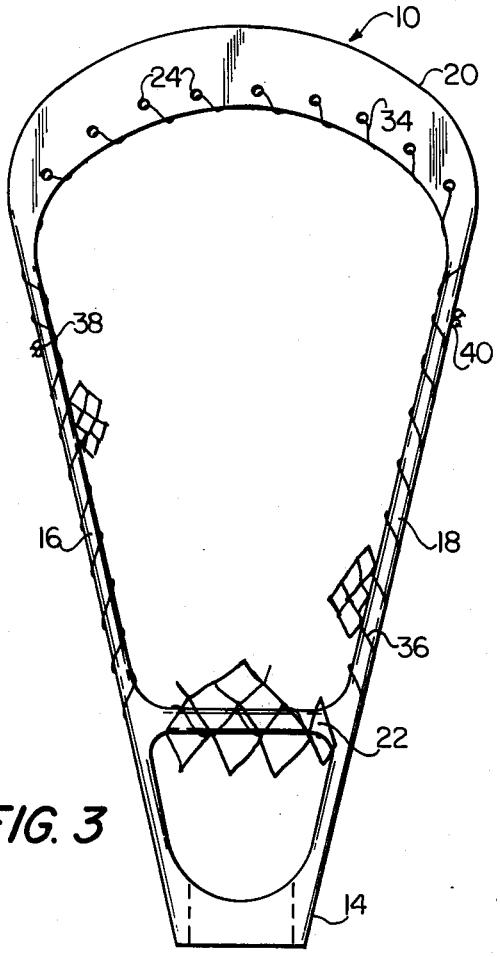
FIG. 3 is a fragmentary back elevational view of the head of FIG. 1 showing the attachment of the net to the head.

Ball release area 30 of net 12 should optimumly be relatively taut. Tension is applied by tying net 12 to head 10. The anchorage is made at openings 24, 26 in the head 10 provided for this purpose, and one or more connecting side strings are looped through net 12 at locations in net 12 proper to generate the desired local tension in net 12. Side string 5 can be secured by any suitable knotting or other fastening arrangement. An effective stringing procedure securing the improved net 30 of the present invention a head 10, as illustrated in FIG. 3, is comprised of only two securing thongs, laces or strings designated 34 and 36 respectively. In this stringing method string 34 is used to fasten the top or throwing region 30 of net 12; string 36 is used to fasten pocket 28 and the remaining portions of net 12. String 34 is secured at an attachment point 38 wall 16 about one third the way down from the top of wall 16, and sequentially passed through net 12 and attachment points, upward and then across wall 20 and subsequently one third the way down the wall 18 where it is ultimately secured at 40. String 36 begins at the same terminus as string 34, and it likewise passes through net 12 and tying points, across the bottom of the stick and up the other side until it terminates at the other terminus of the string 34. Adjustment of pocket depth is made by loosening or tightening the bottom or pocket string 36, and tautness in the thrown; or ball release region 30 of net 12 is fixed by firmly securing top string 34.

In summary, I have invented and produced a novel lacrosse net with preformed shape appropriate to good handling and accurate throwing the shape of which is relatively fixed and unaltered with normal use, where the shape is primarily generated by alterations in the net density; where the changes in net density are either relatively continuous changes in net interstices size, or bands of relatively constant interstices size which have different sizes in adjacent bands.

I claim:

1. One lacrosse stick having a handle with a longitudinal axis and a head adapted to be secured to the handle, comprising a generally V-shaped frame covered by a net, the frame being defined by two side walls which diverge from a junction, a transverse wall joining the opposite end of the side walls, and a transverse stop spaced from the junction which joins the side walls; the improvement wherein said net comprises:

a flexible web of a non-plastically deformable material containing preformed regions for facilitating catching and throwing with the lacrosse stick, the catching region being an area centered on the extended longitudinal axis of the handle, said region having at least its side and top boundaries defined by preformed interstices of first sizes with its center portion containing preformed interstices of larger size than said first sizes, the size of the preformd interstices as measured by their perimeters becoming progressively larger as their distance from the boundaries toward the center portion increases.

2. The improved net as claimed in claim 1 wherein said center portion of said catching region is at least partially elliptical and in a plane parallel to the plane of said head.

3. The improved net as claimed in claim 2 wherein intermediate said catching reagion and said throwing region is a plurality of partially eliptical regions whose apexes are directed towards the center of the transverse wall, each of said shaped regions containing interstices of approximately equal size.

4. In a lacrosse stick as claimed in claim 1, the improvement further comprising means for varying the position of said catching and throwing regions when said web covers the head, said means comprising first means for connecting said throwing region of said web to the head, said means connecting said throwing region from a first point on one of the side walls, along the side wall to the transverse wall, along the transverse wall, and from the transverse wall along the other side wall to a second point transversely opposite said first point, the location of said first and second points determining the position of said throwing region; and second means for connecting the remainder of said web to the head, said means connecting the remainder from said first point, along the side wall to the stop, along the stop, from the stop along the other side wall to said second point, the amount of said web transversely connected between the side walls determining the depth of said catching region.

* * * * *